US010882048B2

(12) United States Patent
Slaven, Jr. et al.

(10) Patent No.: US 10,882,048 B2
(45) Date of Patent: Jan. 5, 2021

(54) APPARATUS AND METHOD FOR CONDITIONING BAMBOO OR VEGETABLE CANE FIBER

(71) Applicant: Resource Fiber LLC, Homewood, AL (US)

(72) Inventors: Leland Slaven, Jr., Tampa, FL (US); David Knight, Bainbridge Island, WA (US)

(73) Assignee: Resource Fiber LLC, Homewood, AL (US)

( * ) Notice: Subject to any disclaimer, the term of this patent is extended or adjusted under 35 U.S.C. 154(b) by 118 days.

(21) Appl. No.: 15/647,061

(22) Filed: Jul. 11, 2017

(65) Prior Publication Data

US 2018/0010298 A1 Jan. 11, 2018

Related U.S. Application Data

(60) Provisional application No. 62/360,905, filed on Jul. 11, 2016.

(51) Int. Cl.
*B02C 4/30* (2006.01)
*D21B 1/06* (2006.01)
(Continued)

(52) U.S. Cl.
CPC ..... *B02C 4/30* (2013.01); *B02C 4/08* (2013.01); *B02C 4/32* (2013.01); *B02C 21/00* (2013.01);
(Continued)

(58) Field of Classification Search
CPC .... B02C 4/02; B02C 4/20; B02C 4/30; B02C 4/32; B02C 4/08; D21B 1/04
See application file for complete search history.

(56) References Cited

U.S. PATENT DOCUMENTS 221,720 A 11/1879 Colburn
2,037,573 A 4/1936 Grant
(Continued)

FOREIGN PATENT DOCUMENTS

GB 1157621 A 7/1969
JP 2000351160 A 12/2000
(Continued)

OTHER PUBLICATIONS

International Searching Authority, International Search Report and Written Opinion, PCT Patent Application PCT/US2019/013713, dated Jun. 21, 2019, 10 pages.
(Continued)

*Primary Examiner* — Teresa M Ekiert
*Assistant Examiner* — Sarkis A Aktavoukian
(74) *Attorney, Agent, or Firm* — Perkins Coie LLP

(57) ABSTRACT

Systems, methods, and apparatus for conditioning bamboo or other types of vegetable cane are provided. In one aspect, the present technology provides a cane processing assembly for use with a substantially flattened sheet of bamboo culm or vegetable cane having a plurality of longitudinally oriented fiber bundles. The assembly comprises first and second conditioning rollers configured to apply pressure to the sheet that breaks at least some natural bonds connecting laterally adjacent fiber bundles in the sheet. The first and second conditioning rollers are adjustable relative to each other so as to vary the pressure applied to the sheet by the first and second conditioning rollers.

21 Claims, 7 Drawing Sheets

(51) Int. Cl.

| | |
|---|---|
| ***B02C 4/08*** | (2006.01) |
| ***B02C 4/32*** | (2006.01) |
| ***B02C 21/00*** | (2006.01) |
| ***B30B 3/04*** | (2006.01) |
| ***B30B 3/00*** | (2006.01) |
| ***D21B 1/04*** | (2006.01) |

(52) U.S. Cl.

CPC ..... *B30B 3/005* (2013.01); *B30B 3/04* (2013.01); *D21B 1/04* (2013.01); *D21B 1/066* (2013.01)

(56) References Cited

U.S. PATENT DOCUMENTS 2,723,693 A 11/1955 Hayashiguchi et al.
2,858,990 A 11/1958 Honeyman et al.
3,289,371 A 12/1966 Pearson et al.
3,358,336 A * 12/1967 Chaikin ..... D01G 11/00 19/128
3,424,270 A 1/1969 Hartman et al.
3,464,877 A * 9/1969 Creighton ..... B27J 1/00 156/259
3,503,833 A 3/1970 Carlson
3,605,360 A 9/1971 Lindal
3,857,217 A 12/1974 Reps
4,134,440 A 1/1979 Kawawa et al.
4,137,685 A 2/1979 Fang et al.
4,195,713 A 4/1980 Hagbjer et al.
4,774,121 A 9/1988 Vollenweider, II
4,799,961 A 1/1989 Friberg
4,810,551 A 3/1989 Chu
4,857,145 A 8/1989 Villavicencio
4,932,178 A 6/1990 Mozingo
4,985,119 A 1/1991 Vinson et al.
5,030,289 A 7/1991 Sattler et al.
5,047,086 A 9/1991 Hayakawa et al.
5,048,581 A * 9/1991 Pierson ..... B27D 1/005 100/121
5,150,553 A 9/1992 Commins et al.
5,151,238 A 9/1992 Earl et al.
5,161,591 A * 11/1992 Sealey ..... B27L 11/08 144/2.1
5,167,710 A 12/1992 Leroux et al.
5,196,061 A 3/1993 Thomas et al.
5,271,996 A 12/1993 Tanabe et al.
5,397,067 A 3/1995 Akiyama et al.
5,415,821 A 5/1995 Irie et al.
5,441,787 A 8/1995 Fujii et al.
5,456,964 A 10/1995 Tamura et al.
5,505,238 A 4/1996 Fujii et al.
5,543,197 A 8/1996 Plaehn
5,561,957 A 10/1996 Gauthier
5,573,348 A 11/1996 Morgan
5,679,191 A 10/1997 Robinson et al.
5,733,671 A 3/1998 Bayasi
5,738,924 A 4/1998 Sing
5,741,589 A 4/1998 Fujii et al.
5,759,463 A 6/1998 Chang
5,786,063 A 7/1998 Shibusawa et al.
5,813,182 A 9/1998 Commins
5,814,170 A 9/1998 Shibusawa et al.
5,876,649 A 3/1999 Ryan
5,881,460 A 3/1999 Nowell, III et al.
5,882,745 A 3/1999 Mi et al.
5,972,467 A 10/1999 Washo et al.
5,976,644 A 11/1999 Sanaee et al.
5,980,672 A * 11/1999 Ryan ..... B27J 1/00 156/169
6,010,585 A 1/2000 Fujii et al.
6,015,107 A * 1/2000 Stegmeier ..... B02C 4/02 241/101.2
6,086,804 A 7/2000 Akiyama et al.
6,098,680 A 8/2000 Nien et al.
6,180,211 B1 1/2001 Held
6,197,414 B1 3/2001 Kawai et al.
6,256,949 B1 7/2001 Meierhofer
6,281,148 B1 8/2001 Dagher et al.
6,383,652 B1 5/2002 Templeton et al.
6,391,435 B1 5/2002 Akiyama et al.
6,513,292 B2 2/2003 Kumon
6,564,837 B1 5/2003 Lou
6,576,331 B1 6/2003 Ryan
6,641,885 B2 11/2003 Lou
6,689,298 B2 2/2004 Yoshida
6,722,093 B2 4/2004 Dauplay
6,737,006 B2 5/2004 Grohman
6,773,500 B1 8/2004 Creamer et al.
6,841,231 B1 1/2005 Liang et al.
6,872,246 B2 3/2005 Merkley et al.
6,875,503 B1 4/2005 Famy et al.
6,929,841 B1 8/2005 Van Dijk et al.
6,976,345 B2 12/2005 Keshmiri
7,147,745 B1 12/2006 Slaven, Jr. et al.
7,152,379 B2 12/2006 Lin et al.
7,160,053 B2 1/2007 Chang
7,166,181 B2 1/2007 Cable
7,172,136 B2 2/2007 Leon
7,225,591 B2 6/2007 Lin et al.
7,276,551 B2 10/2007 Pageau
7,537,031 B2 * 5/2009 Jarck ..... B27N 1/00 144/1.1
7,785,681 B2 8/2010 Liao
7,908,808 B2 3/2011 Hundegger
7,914,637 B2 * 3/2011 Pedoja ..... B32B 5/022 156/167
7,939,156 B1 5/2011 Slaven, Jr. et al.
8,075,735 B2 * 12/2011 Jarck ..... B27J 7/00 162/27
8,173,236 B1 5/2012 McDonald
8,231,757 B2 7/2012 Lin et al.
8,245,742 B2 8/2012 Filion et al.
8,268,430 B2 * 9/2012 Johnson ..... B27N 1/00 428/54
8,561,373 B1 10/2013 McDonald et al.
8,776,316 B2 7/2014 Mcroskey et al.
9,624,609 B2 4/2017 Rumeau et al.
9,937,685 B2 4/2018 Slaven, Jr. et al.
10,087,630 B2 10/2018 Hebel et al.
10,266,987 B2 4/2019 Slaven, Jr. et al.
2002/0095897 A1 7/2002 Summerford
2003/0079804 A1 5/2003 Hsu
2003/0207098 A1 11/2003 Ryan
2004/0191448 A1 9/2004 Wu
2005/0048273 A1 * 3/2005 Ryan ..... B29C 44/322 428/297.4
2005/0087904 A1 4/2005 Bryan
2005/0161852 A1 7/2005 Decker et al.
2005/0163990 A1 7/2005 Chang
2005/0173089 A1 8/2005 Liang et al.
2008/0023868 A1 1/2008 Slaven et al.
2010/0178451 A1 7/2010 Li
2013/0210309 A1 8/2013 Kim et al.
2014/0000761 A1 1/2014 Peng
2014/0208688 A1 7/2014 Vitullo
2015/0129698 A1 * 5/2015 Olson ..... B02C 18/16 241/230
2015/0158263 A1 * 6/2015 Maddala ..... B31F 1/07 427/147
2015/0197069 A1 7/2015 Basquin et al.
2015/0197396 A1 * 7/2015 Simons ..... B65G 65/4881 118/255
2015/0275428 A1 10/2015 Slaven et al.
2017/0030089 A1 2/2017 Zhang et al.
2017/0260755 A1 9/2017 Sherstad et al.
2017/0299198 A1 10/2017 Collins et al.
2017/0356193 A1 12/2017 Song et al.
2018/0299230 A1 10/2018 Slaven, Jr. et al.
2018/0354562 A1 12/2018 Slaven, Jr. et al.
2019/0226196 A1 7/2019 Slaven, Jr. et al.

(56) References Cited

U.S. PATENT DOCUMENTS

FOREIGN PATENT DOCUMENTS

| | | | | |
|---|---|---|---|---|
| JP | 4791437 | B2 | * | 10/2011 |
| WO | 2009146254 | A1 | | 12/2009 |

OTHER PUBLICATIONS

International Searching Authority, International Search Report and Written Opinion, PCT Patent Application PCT/US2019/025550, dated Jun. 26, 2019, 12 pages.

* cited by examiner

APPARATUS AND METHOD FOR CONDITIONING BAMBOO OR VEGETABLE CANE FIBER

CROSS-REFERENCE TO RELATED APPLICATION

This application hereby claims priority to U.S. Provisional Patent Application No. 62/360,905, titled "Apparatus and Method for Conditioning Bamboo or Vegetable Cane Fiber," filed Jul. 11, 2016, which is incorporated by reference herein in its entirety.

TECHNICAL FIELD

This disclosure relates to a device for processing bamboo or vegetable cane that increases flexibility by separating fibers substantially without compromising strength.

BACKGROUND

Bamboo and other vegetable cane contain extremely strong fibers that, unless separated, maintain a memory of individual growth patterns. This makes it difficult to produce a product made of the fibers that is more dense for specific industrial needs. The cylindrical bamboo stalks or culms have a plurality of fiber bundles along their length, and these bundles give superior strength joining one to another. Once the culms are flattened by allowing them to break along their natural fiber boundaries they are ready for further processing or conditioning. Conventional process methods use a cutting device that compromises the strength of the long fibers when material is removed.

SUMMARY

The present disclosure describes embodiments of apparatus, systems, and methods for processing bamboo and/or other vegetable cane that overcomes the drawbacks in the prior art and provides other benefits. The present technology can allow for better reconsolidation of bamboo or other vegetable cane fibers for improved mechanical properties with engineered products. In at least one embodiment, a system is provided for processing axially split bamboo or other vegetable cane culms of variable lengths to provide substantially flat conditioned sheets substantially without cutting (i.e., shortening) the fibers while allowing the fibrous materials to remain joined together in a flat, substantially planar sheet. The system includes apparatus that separates bamboo or other vegetable cane fiber bundles from laterally adjacent fiber bundles in multiple areas along the length of the culm, to allow the culm to remain joined together after fully separating the fiber along the length of the culm without cutting or removal of fiber.

For example, at least one aspect of the present technology provides a cane processing assembly for use with a substantially flattened sheet of bamboo culm or vegetable cane having a plurality of longitudinally oriented fiber bundles. The assembly comprises first and second conditioning rollers. The first conditioning roller has a first set of alternating grooves and protrusions. The second conditioning roller has a second set of alternating grooves and protrusions. The assembly also comprises a frame coupling the first and second conditioning rollers in a position adjacent to each other with the first set of alternating grooves and protrusions interleaved with the second set of alternating grooves and protrusions to form a conditioning nip. The first and second conditioning rollers are configured to apply pressure to the sheet at the conditioning nip that breaks at least some natural bonds connecting laterally adjacent fiber bundles in the sheet. The assembly also comprises a roller biasing unit coupled to the first and second conditioning rollers. The roller biasing unit is configured to adjust the position of the first and second conditioning rollers relative to each other so as to vary the pressure applied to the sheet by the first and second conditioning rollers. The assembly also comprises a drive motor coupled to the frame. The drive motor is configured to rotate the first and second conditioning rollers in opposing directions so as to advance the sheet through the conditioning nip.

Another aspect of the present technology provides a cane processing assembly for use with a substantially flattened sheet of bamboo culm or vegetable cane having a plurality of longitudinally oriented fiber bundles. The assembly comprises first and second conditioning rollers. The first conditioning roller has a first set of alternating grooves and protrusions. The second conditioning roller has a second set of alternating grooves and protrusions. The first and second conditioning rollers are positioned adjacent to each other with the first set of alternating grooves and protrusions interleaved with the second set of alternating grooves and protrusions so as to form a conditioning nip. The first and second conditioning rollers are configured to apply pressure to the sheet at the conditioning nip that breaks at least some natural bonds connecting laterally adjacent fiber bundles in the sheet. The first and second conditioning rollers are adjustable relative to each other so as to vary the pressure applied to the sheet by the first and second conditioning rollers. The assembly further comprises a drive assembly coupled to at least one of the first or second conditioning rollers. The drive assembly is configured to rotate the first and second conditioning rollers in opposing directions so as to advance the sheet through the conditioning nip.

Another aspect of the present technology provides a cane processing system for use with a substantially flattened sheet of bamboo culm or vegetable cane, the sheet having a longitudinal axis and a plurality of longitudinally oriented fiber bundles substantially parallel to the longitudinal axis and connected laterally to each other by natural bonds. The system comprises a cane conditioning assembly having a plurality of conditioning roller sets. Each conditioning roller set comprises a first conditioning roller, a second conditioning roller, a frame, and a roller biasing unit. The first conditioning roller has a first set of alternating grooves and protrusions. The second conditioning roller has a second set of alternating grooves and protrusions. The frame couples the first and second conditioning rollers in a position adjacent to each other with the first set of alternating grooves and protrusions interleaved with the second set of alternating grooves and protrusions to form a conditioning nip. The first and second conditioning rollers are configured to apply pressure to the sheet at the conditioning nip that breaks at least some of the natural bonds connecting laterally adjacent fiber bundles in the sheet. The roller biasing unit is coupled to the first and second conditioning rollers. The roller biasing unit is configured to adjust the position of the first and second conditioning rollers relative to each other so as to vary the pressure applied to the sheet by the first and second conditioning rollers. The system also includes an input conveying unit positioned to receive and advance the sheet into the cane conditioning assembly. The system also includes an output conveying unit positioned to receive the sheet from the cane conditioning assembly.

DETAILED DESCRIPTION

Figure 1:
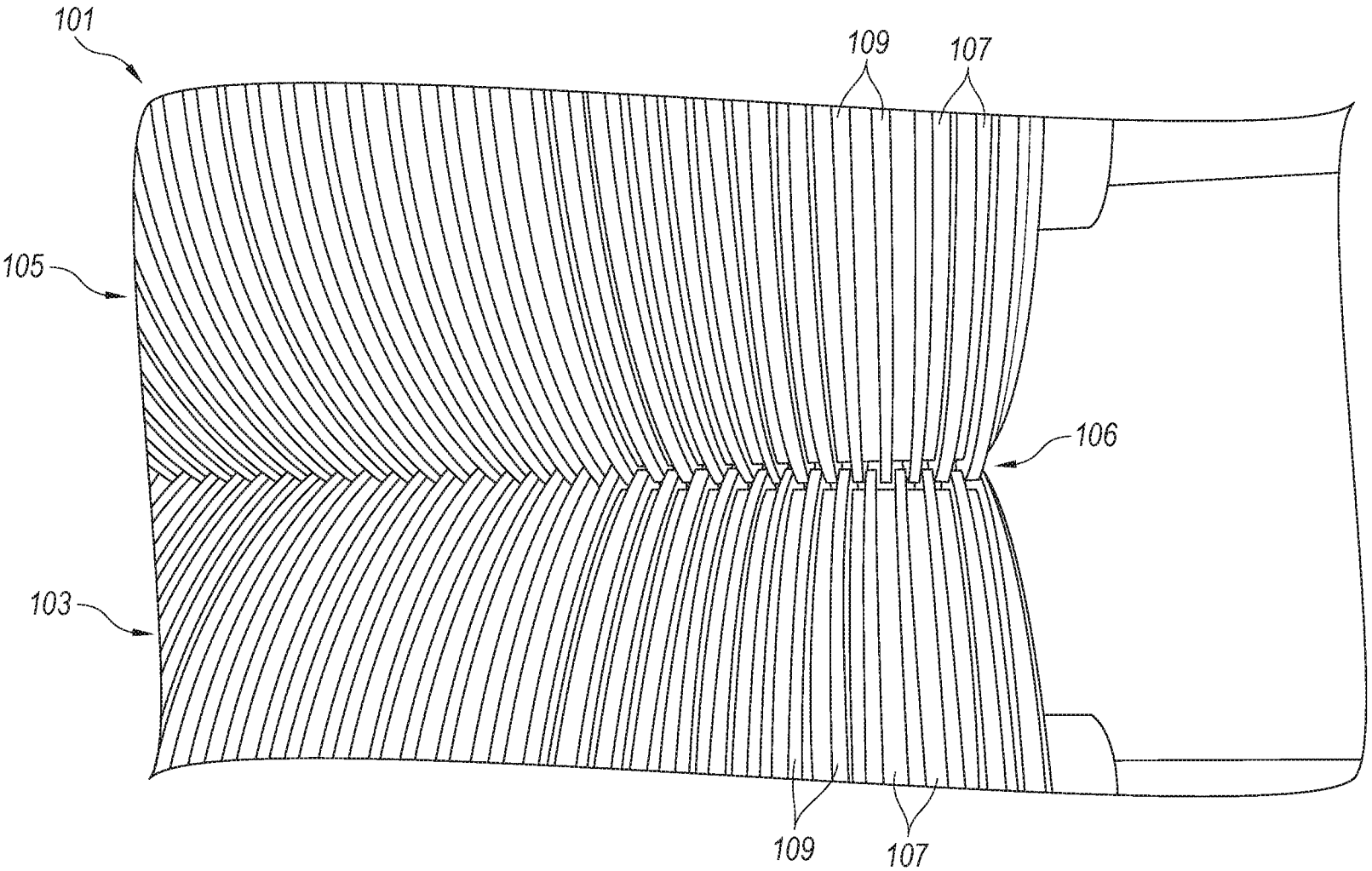
FIG. 1 is a partial isometric view of a set of grooved rollers in a conditioning assembly in accordance with an embodiment of the present technology and configured to allow a flattened culm to pass between the rollers to further separate laterally adjacent fiber bundles along their natural fiber boundaries, which conditions the culm to a more pliable state for further processing.

Several embodiments of the technology are described in more detail in reference to FIGS. 1-8. Embodiments in accordance with the present disclosure are set forth hereinafter to provide a thorough understanding and enabling description of a number of particular embodiments. Numerous specific details of various embodiments are described below. In some instances, well-known structures or operations are not shown, or are not described in detail to avoid obscuring aspects of this technology. A person skilled in the art will understand, however, that the technology may have additional embodiments, or that the technology may be practiced without one or more of the specific details of the embodiments as shown and described.

The following discussion provides an illustrative example of the technology and components in connection with a system for processing bamboo or other types of vegetable canes to separate laterally adjacent fibers along their length without cutting or removal of the fiber. The following discussion provides an illustrative example of the technology and components in connection with the system and associated methods. One or more specific and alternative embodiments of the present invention will now be described with reference to the attached drawings. It shall be apparent to one skilled in the art, however, that this invention may be practiced without such specific details. Some of the details may not be described at length so as not to obscure the invention. For ease of reference, common reference numerals or series of numerals will be used throughout the figures when referring to the same or similar features common to the figures.

While the illustrated embodiment is discussed in connection with processing bamboo, it is to be understood that the system and/or aspects of the system can be used for processing other fibrous vegetable cane. Further, the system and its components can be arranged in a stationary configuration, such as in a factory, or the system and its components can be provided on a mobile configuration that allows the system to be moved and operated at selected locations.

FIG. 1 shows a portion of a culm conditioning assembly 101 in accordance with an embodiment of the present technology. The assembly 101 is used to process a substantially flattened sheet of bamboo culm or other vegetable cane having a plurality of longitudinally oriented fiber bundles. The embodiment described herein is discussed in connection with a flattened bamboo culm, although the assembly 101 can be used with other flattened sheets of vegetable fiber. The bamboo culm can be flattened using the process as described in U.S. patent application Ser. No. 14/673,659, titled APPARATUS AND METHOD FOR PROCESSING BAMBOO OR VEGETABLE CANE, filed Mar. 30, 2015, and which is incorporated herein in its entirety by reference thereto.

The assembly 101 of the present technology has a first conditioning roller 103 adjacent to a mating second conditioning roller 105 defining a conditioning nip 106 therebetween. Each of the first and second rollers 103 and 105 can be metal, cylindrical, ribbed structures with alternating grooves 107 and protrusions 109. Although the illustrated embodiment utilizes metal rollers 103 and 105, other embodiments can use other suitable materials for the conditioning rollers.

The first and second rollers 103 and 105 can be spaced and aligned such that protrusions 109 of the first roller 103 are partially received within corresponding grooves 107 of the second roller and vice versa. This configuration allows a sheet of flattened culm (i.e., bamboo or other vegetable fiber) to be passed between the two mating conditioning rollers 103 and 105. The opposing grooves 107 and protrusions 109 of the mating rollers are interleaved to form a conditioning nip 106 and are configured to further separate the bamboo along its natural fiber boundaries. The mating rollers 103 and 105 are configured to firmly engage the flattened culm and to fracture the natural bonds between many of the laterally adjacent fiber bundles along the length of the bamboo culm, so as to provide a more pliable culm for further processing without unduly sacrificing the integrity and/or tensile strength of the bamboo fibers. While the conditioning rollers 103 and 105 break the bonds between many of the lateral fiber bundles, the fibers across the width of the culm remain interconnected such that the culm remains in a conditioned sheet configuration, which may be further processed downstream of the assembly 101.

The first and second rollers 103 and 105 can be spring-biased towards one another to apply pressure to the bamboo culm as it passes through the conditioning nip 106 between the first and second rollers 103 and 105. The grooves 107 can have various widths in different embodiments, for example ⅜", ¼", ⅛", or other suitable sizes. In some embodiments, the depth of the grooves 107 can be approximately 0.2".

The rollers 103 and 105 are substantially parallel to each other and positionable so the grooves 107 of each roller are opposite the protrusions 109 of the other roller. Each groove 107 is sized with a width greater than the width of the mating protrusion 109 so the protrusion 109 can be in or adjacent to the mating groove 107 to define a receiving portion through which the portion of the culm passes as it moves between the rollers. As the culm moves through the receiving portion, the culm is squeezed between mating grooves 107 and protrusions 109 with a shearing load that breaks the bonds of the laterally adjacent fiber bundles.

The assembly 101 can include one or more sets of guide rollers that receive and advance the culm through the conditioning rollers 103 and 105. For example, a set of guide rollers can include one or more pushing rollers positioned adjacent to and upstream of the rollers 103 and 105 to push the culm through the rollers 103 and 105. Alternatively or in combination, a set of guide rollers can include one or more pulling rollers positioned adjacent to and downstream of the rollers 103 and 105 to pull the culm through the rollers 103 and 105.

Figure 2:
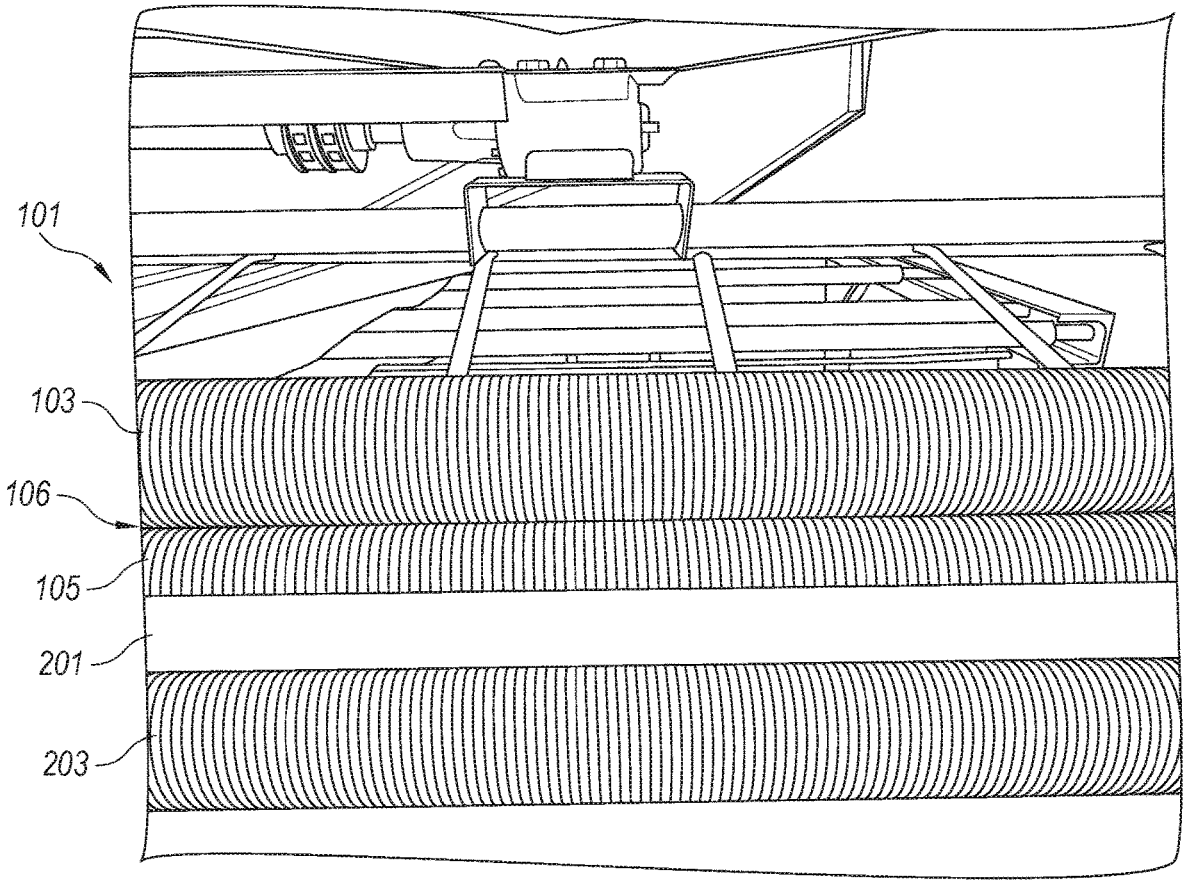
FIG. 2 is an enlarged elevation view of the assembly of FIG. 1 with a set of pulling rollers to guide the culm into the conditioning rollers for conditioning.

FIG. 2 is a side elevation view of the assembly 101 of FIG. 1 with a set of pulling rollers 201 and 203 to guide the culm into the first and second rollers 103 and 105 for conditioning. The first pulling roller 201 can be a metallic cylinder with a substantially smooth surface while the second pulling roller 203 can be a substantially cylindrical roller with rubber tread. The first and second pulling rollers 201 and 203 can be spaced in contact or nearly in contact with one another with a spring bias to apply pressure to the culm as it exits the conditioning rollers 103 and 105 and is fed between the first and second pulling rollers 201 and 203. One or both of the pulling rollers 201 and 203 can be driven by a motor or other drive system that causes the roller(s) to rotate, thereby pulling the culm through the pulling rollers 201 and 203 and through the conditioning rollers 103 and 105.

Figure 3:
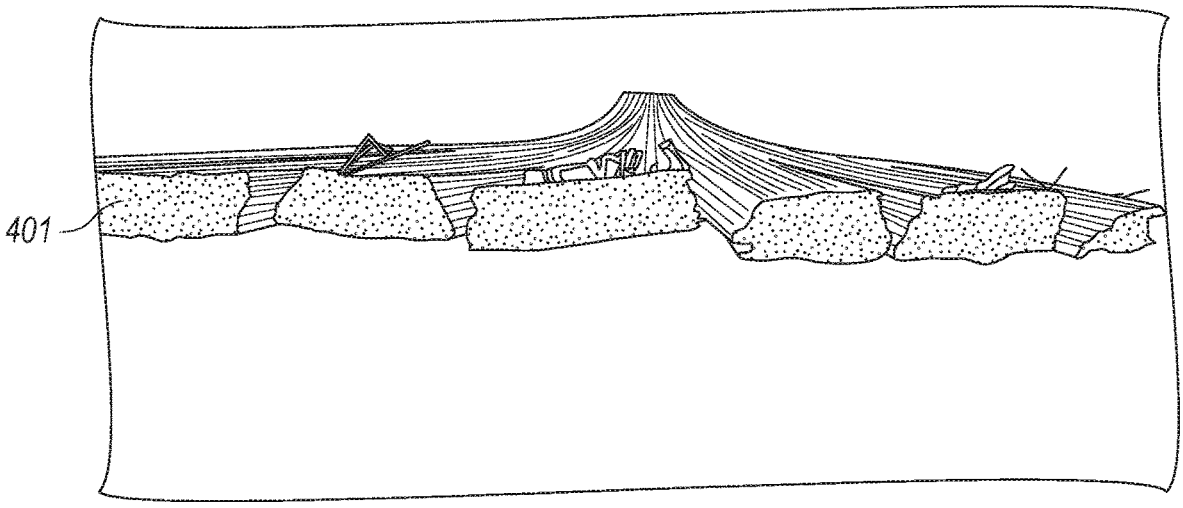
FIG. 3 is an end elevation view of a flattened culm before passing through the assembly of FIG. 2 for further conditioning or fiber separation.
Figure 4:
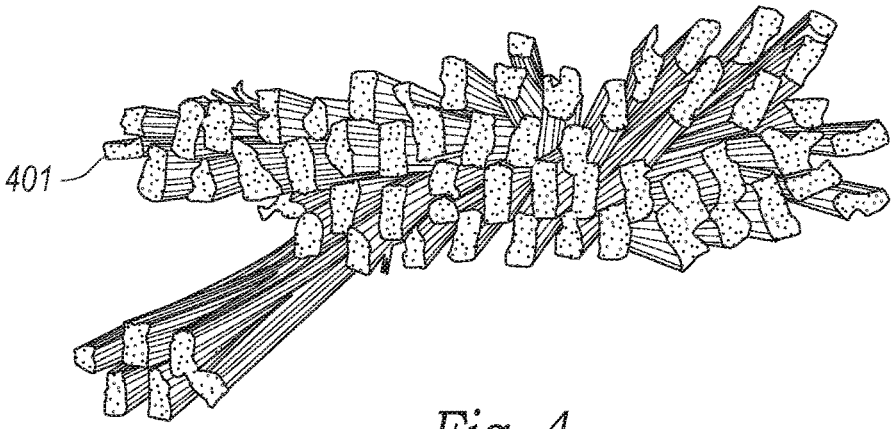
FIG. 4 is an end elevation view of a flattened culm after passing through the assembly of FIG. 2 for further conditioning or fiber separation.

FIG. 3 is an end elevation view of a flattened culm 401 before passing through the conditioning assembly 101 of FIGS. 1 and 2, and FIG. 4 is an end elevation view of a flattened culm 401 after passing through the conditioning assembly 101 of FIGS. 1 and 2. As shown in FIGS. 3 and 4, after passing through the conditioning assembly 101 the flattened culm 401 is divided into smaller strips via the first and second conditioning rollers 103 and 105. These smaller strips of fiber bundles maintain the longitudinal integrity of the fibers in the culm 401, while still allowing the strips to be more easily processed due to their reduced size.

Figure 5:
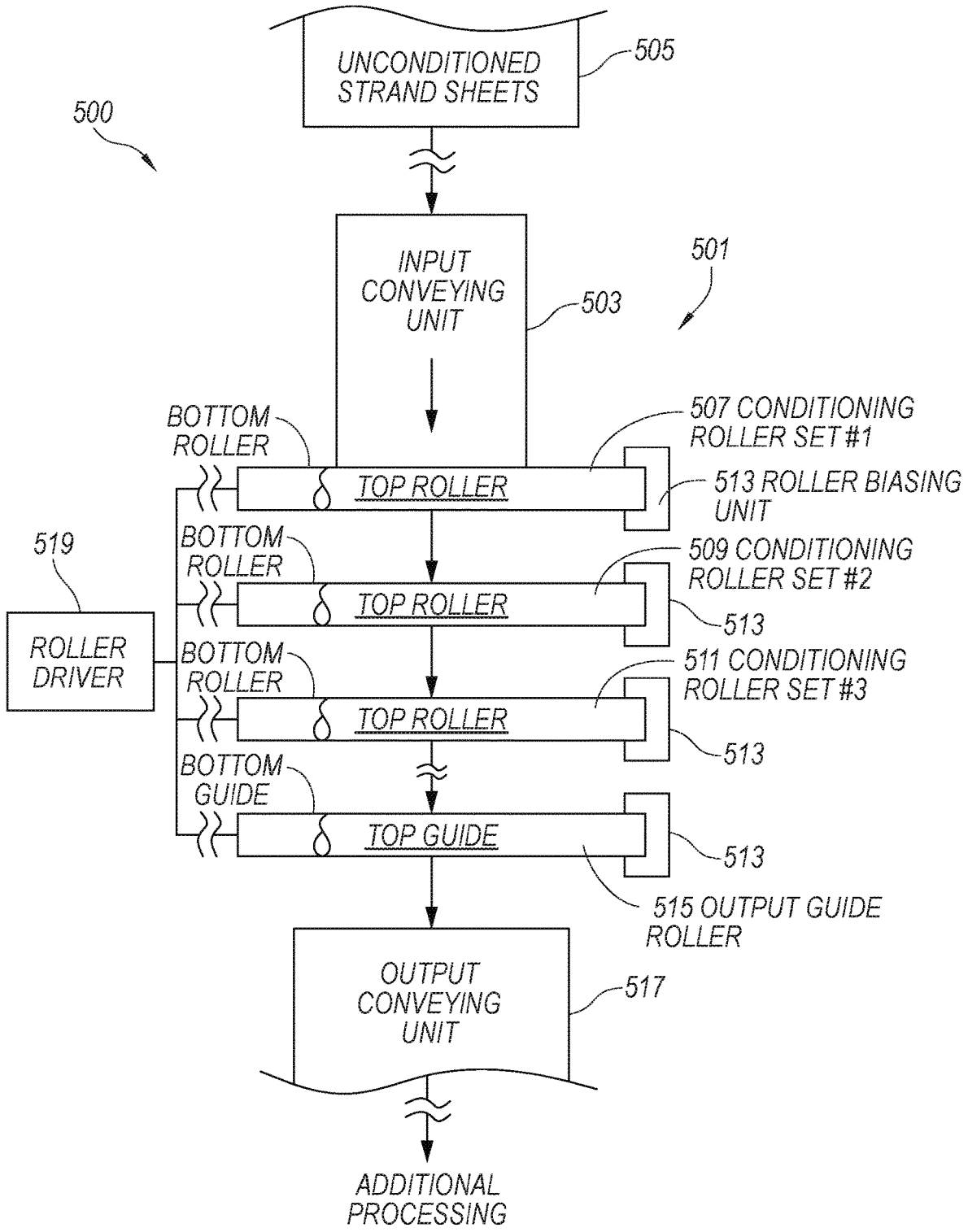
FIG. 5 is a schematic view of a system with a conditioning assembly having a plurality of sets of conditioning rollers.

FIG. 5 is a schematic illustration of a culm conditioning system 500 having a plurality of sets of conditioning rollers. The system 500 includes an input conveying unit 503 (e.g., an infeed conveyor or guide) positioned to receive and advance the flattened bamboo culms 505 axially into a conditioning assembly 501. The illustrated assembly 501 includes a first conditioning roller set 507, a second conditioning roller set 509, and a third conditioning roller set 511 in sequential order. Each of these conditioning roller sets 507, 509, 511 can include a top roller and a bottom roller (e.g., substantially similar to the first and second rollers 103 and 105 of FIGS. 1 and 2).

Each of these conditioning roller sets 507, 509, 511 can also be coupled to a roller biasing unit 513. These biasing units 513 can spring bias the top and/or bottom rollers of each conditioning roller set 507, 509, 511 to adjust the size of the conditioning nip 106 between the rollers and to provide varying degrees of force to the culm depending on the desired degree of conditioning to be applied to the culm by the particular set of conditioning rollers. For example, in some embodiments, the conditioning rollers of each pair can be adjustable relative to each other (e.g. up and down) by springs, cylinders, or threaded adjustment components that allow a culm to pass through each set of rollers under a selected pressure to achieve the desired degree of conditioning. One or more sets of conditioning rollers can be configured as bypass rollers that do not apply conditioning forces to the flattened culm passing therethrough so as to not condition the culm, which has been, or will be conditioned by another set of the conditioning rollers in the assembly 501.

Once the culm passes through the first set of rollers, many laterally adjacent fiber bundles are separated from each other, yet the conditioned culm is still held together in a sheet arrangement by other interconnected fiber bundles. Depending on the end product desired, passing the selected flattened culm through the first set of rollers may be sufficient, in which case the biasing units 513 of the second and third conditioning roller sets 509 and 511 can be adjusted to the bypass configuration to allow greater separation in those roller sets, thereby reducing or eliminating any further processing performed by those roller sets 509 and 511.

Each of the conditioning roller sets 507, 509, and 511 can be configured to have varying groove sizes and/or different degrees of spring bias. For example, the first conditioning roller set 507 may have grooves with ⅜" width, while the second conditioning roller set 509 has grooves with ¼" width, and the third conditioning roller set 511 has grooves with ⅛" width. In such a configuration, each subsequent conditioning roller set further divides and processes the laterally adjacent fiber bundles in the culm. In other embodiments the groove sizing and relative order of the conditioning rollers can vary. For example, all of the conditioning rollers can have grooves of the same size, or having increasingly larger grooves in subsequent conditioning rollers.

An output guide roller 515 is provided adjacent to the third conditioning roller set 511 and is configured to receive the conditioned flattened culm as it exits the third conditioning roller set 511. The output guide roller 515 engages the culm to pass it forwardly to the adjacent output conveying unit 517 (e.g., an outfeed conveyor or guide) positioned to advance the culm away for further processing. The output guide roller 515 can be similar to the pulling rollers 201 and 203 of FIG. 2, for example having a metallic roller and an adjacent rubber-treaded roller to pull the conditioned fiber between the two. The output guide roller 515 can also be coupled to a roller biasing unit 513 that can spring-bias top and bottom rollers of the output guide roller 515 to press toward one another with varying degrees of force and distance depending on the desired configuration.

Each of the conditioning roller sets 507, 509, and 511 as well as the output guide roller 515 can be coupled to a roller driver 519 that controls rotation of one or both of the rollers in a given set. For example, the roller driver 519 can be an electrical motor that causes the top and bottom rollers to rotate in opposite directions so as to draw the culm from the input conveying unit 503, feed it through and between each of the roller sets 507, 509, 511, and 515, and direct it forwardly to the output conveying unit 517.

Figure 6:
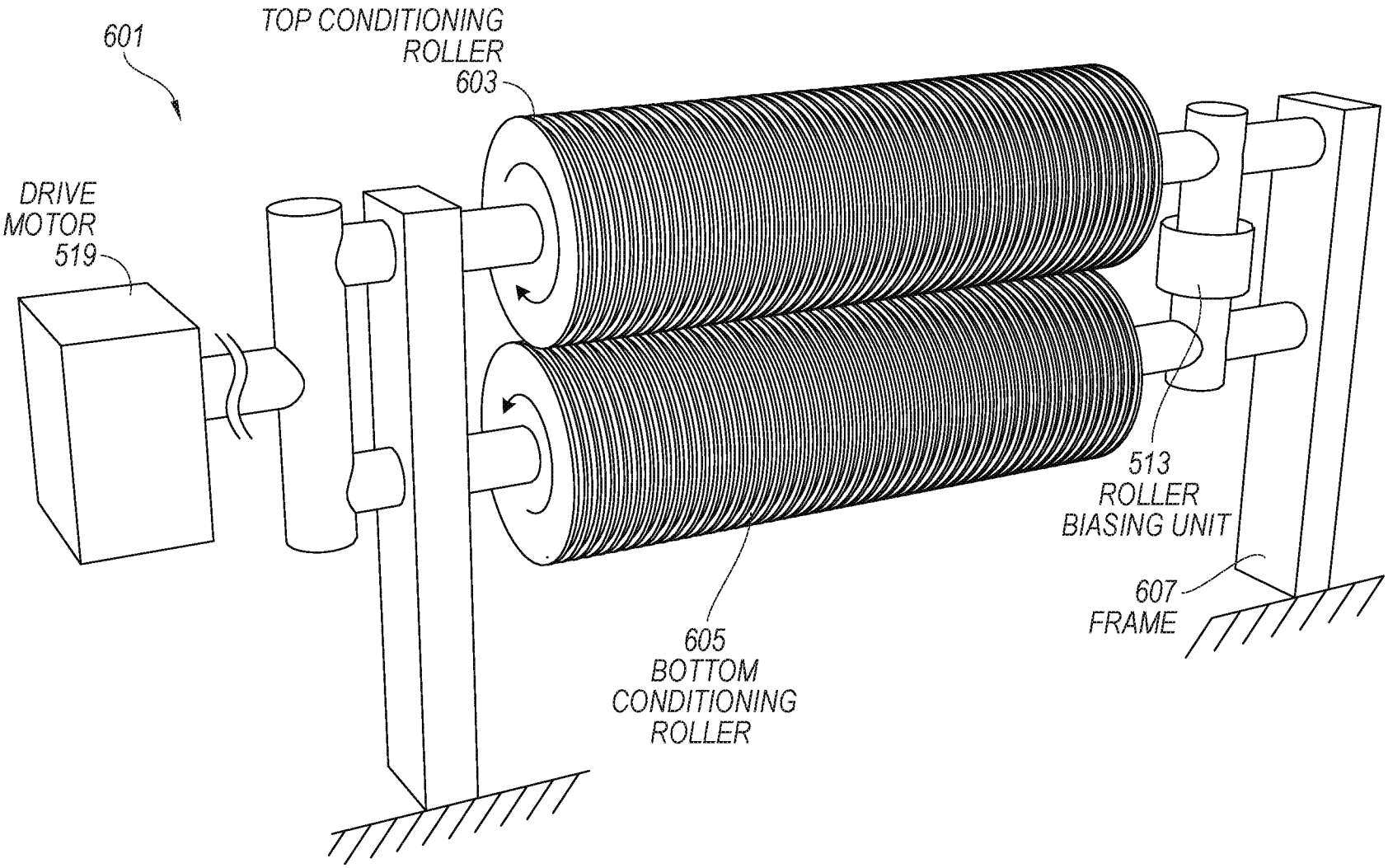
FIG. 6 is an isometric view of a set of grooved conditioning rollers of the assembly of FIG. 5 showing one option for a drive device and adjustment, though many types could be used.

FIG. 6 shows one set 601 of grooved conditioning rollers showing one option for a drive device and adjustment, though many types could be used. The set 601 includes a top conditioning roller 603 and a bottom conditioning roller 605. These two rollers 603 and 605 are coupled to and supported by the frame 607. The rollers 603 and 605 are spring-biased towards one another by the roller biasing unit 513, which can vary the degree of bias depending on the desired configuration. The driver motor 519 controls and drives the rotation of the rollers 603 and 605 in opposite directions so that the culm can be fed through the space between the two rollers 603 and 605. During this process, the interlacing grooves and protrusions in the rollers 603 and 605 break the bonds and divide the fiber bundles of the culm along their length.

Figure 7:
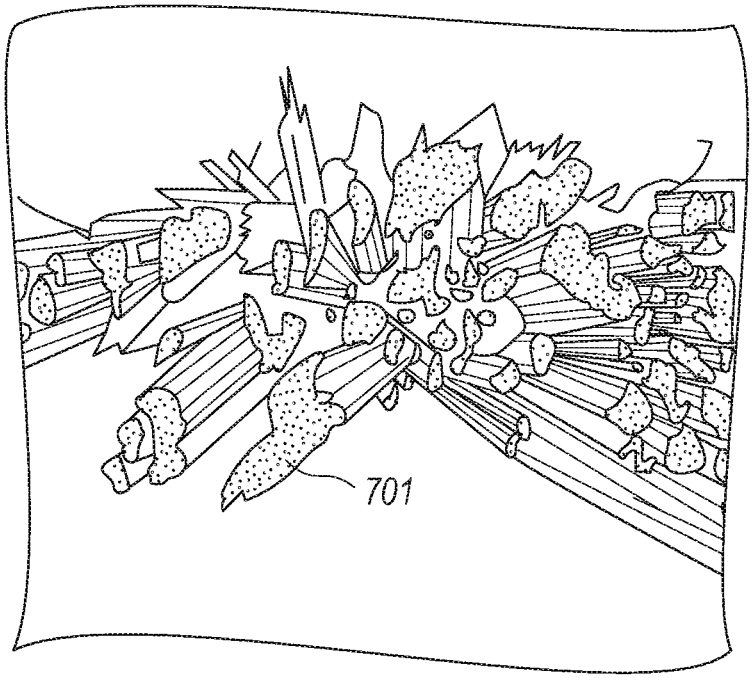
FIG. 7 is an end view of a culm of bamboo or vegetable cane conditioned by the assembly of FIG. 5 to a more pliable state for further processing.

FIG. 7 shows bamboo or vegetable cane 701 conditioned to a more pliable state for further processing by passing through more than one set of rollers or one set of rollers multiple times. As compared to the conditioned fiber in FIG. 4, the fibers in FIG. 7 have been broken down into smaller strips while maintaining integrity of the fibers along their length.

Figure 8:
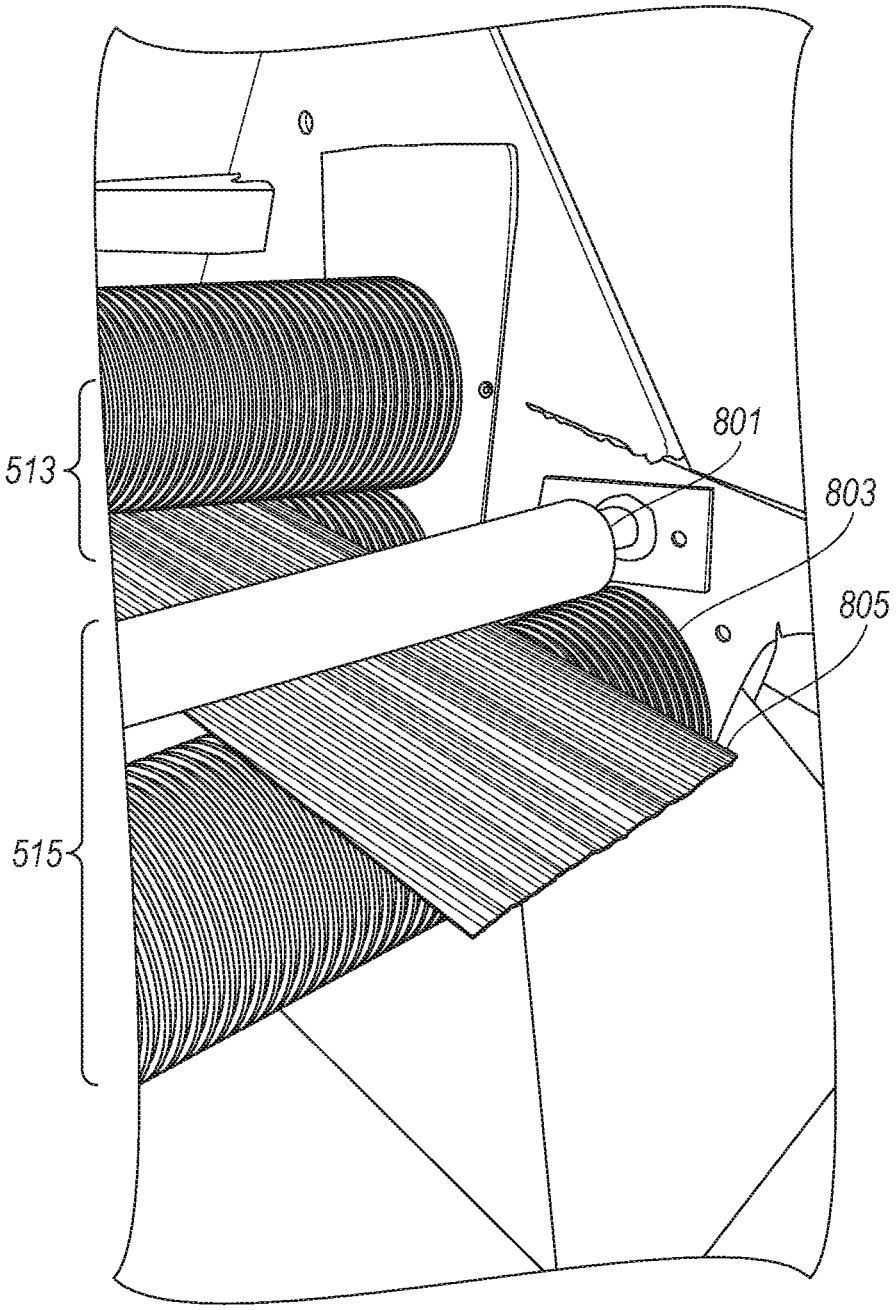
FIG. 8 is a partial isometric view of the assembly of FIG. 5 with a guide roller on the end of the assembly that helps pull the sheet of conditioned fibers out of the assembly.

FIG. 8 shows the output guide roller 515 including a top roller 801 and bottom roller 803 that pulls the conditioned culm 805 out of the assembly to evacuate all fiber for further processing. As noted previously, the top and bottom rollers 801 and 803 of the output guide roller 515 can be similar to the pulling rollers 201 and 203 of FIG. 2, for example having a metallic roller and an adjacent rubber-treaded roller to pull the conditioned fiber between the two. The output guide roller 515 can also be coupled to a roller biasing unit that can spring bias the top and bottom rollers 801, 803 of the output guide roller 515 to press toward one another with varying degrees of force and distance depending on the desired configuration.

From the foregoing, it will be appreciated that specific embodiments of the technology have been described herein for purposes of illustration, but that various modifications may be made without deviating from the spirit and scope of the technology. Further, certain aspects of the technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The above Detailed Description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. The teachings of the disclosure provided herein can be applied to other apparatus, systems and/or methods, not necessarily those described above. The elements and acts of the various examples described above can be combined to provide further implementations of the disclosure. Some alternative implementations of the disclosure may include not only additional elements to those implementations noted above, but also may include fewer elements. Thus, the disclosure is not limited except as by the appended claims.

We claim:

1. A cane processing assembly for use with a substantially flattened sheet of bamboo culm or vegetable cane, wherein the sheet has a plurality of longitudinally oriented fiber bundles, the assembly comprising:

a first conditioning roller having a circumferentially aligned first set of alternating rectangular grooves having sidewalls positioned apart at a first width and protrusions having a second width, wherein the first width is greater than the second width;

a second conditioning roller having a circumferentially aligned second set of alternating rectangular grooves having sidewalls positioned apart at the first width and protrusions having the second width;

a frame coupling the first and second conditioning rollers in a position adjacent to each other with the first set of alternating rectangular grooves and protrusions interleaved with the second set of alternating rectangular grooves and protrusions such that each protrusion is partially received in a mating rectangular groove to form a conditioning nip;

a roller biasing unit coupled to the first and second conditioning rollers and configured to adjust the position of the first and second conditioning rollers relative to each other so as to vary a pressure applied to the sheet at the conditioning nip by the first and second conditioning rollers;

a first guide roller having a smooth first cylindrical surface coupled to the frame;

a second guide roller coupled to the frame and positioned adjacent to the first guide roller, the second guide roller having a second cylindrical surface with grooved treads, wherein the grooved treads are configured to move the sheet through the first and second guide rollers and to push or pull the sheet through the conditioning nip; and a drive motor coupled to the frame and configured to rotate the first and second guide rollers and the first and second conditioning rollers so as to advance the sheet through the conditioning nip in a direction such that the plurality of longitudinally oriented fiber bundles are aligned with the first and second set of alternating rectangular grooves and protrusions, wherein the pressure applied to the sheet at the conditioning nip breaks only some natural bonds connecting laterally adjacent fiber bundles in the sheet.

2. The cane processing assembly of claim 1 wherein the first and second conditioning rollers are made of metal.

3. The cane processing assembly of claim 1 wherein the first width is in a range of ⅛" to ⅜".

4. The cane processing assembly of claim 1 wherein the rectangular grooves of the first and second conditioning rollers each have a depth of 0.2".

5. The cane processing assembly of claim 1 wherein the roller biasing unit is configured to spring bias the first and second conditioning rollers towards each other.

6. The cane processing assembly of claim 1 wherein the first and second guide rollers are push rollers positioned adjacent to the first and second conditioning rollers and configured to push the sheet toward the first and second conditioning rollers.

7. The cane processing assembly of claim 1 wherein the first and second guide rollers are pull rollers configured to pull the sheet through the first and second conditioning rollers.

8. The cane processing assembly of claim 1 wherein the first guide roller is a metallic roller, and the second guide roller is a rubber-treaded roller.

9. The cane processing assembly of claim 1 wherein the first guide roller is made of metal and the grooved treads of the second guide roller are made of rubber.

10. The cane processing assembly of claim 1 wherein the first and second guide rollers are spring biased toward each other to apply pressure to the sheet.

11. A cane processing assembly for use with a substantially flattened sheet of bamboo culm or vegetable cane, wherein the sheet has a plurality of longitudinally oriented fiber bundles, the assembly comprising:

a first conditioning roller having a circumferentially aligned first set of alternating rectangular grooves having sidewalls positioned apart at a first width and protrusions having a second width;

a second conditioning roller having a circumferentially aligned second set of alternating rectangular grooves having sidewalls positioned apart at the first width and protrusions having the second width;

wherein the first and second conditioning rollers are positioned adjacent to each other with the first set of alternating rectangular grooves and protrusions interleaved with the second set of alternating rectangular grooves and protrusions such that each protrusion is partially received in a mating rectangular groove so as to form a conditioning nip, the first and second conditioning rollers configured to apply a pressure to the sheet at the conditioning nip, the first and second conditioning rollers being adjustable relative to each other so as to vary the pressure applied to the sheet at the conditioning nip by the first and second conditioning rollers;

a roller biasing unit coupled to the first and second conditioning rollers and configured to spring bias the first and second conditioning rollers towards each other;

a first guide roller having a smooth first cylindrical surface;

a second guide roller positioned adjacent to the first guide roller, the second guide roller having a second cylindrical surface with grooved treads, wherein the grooved treads are configured to move the sheet through the first and second guide rollers and to push or pull the sheet through the conditioning nip; and a drive assembly coupled to the second guide roller and to at least one of the first or second conditioning rollers and configured to rotate the first and second conditioning rollers so as to advance the sheet through the conditioning nip in a direction such that the plurality of longitudinally oriented fiber bundles are aligned with the first and second set of alternating rectangular grooves and protrusions, wherein the pressure applied to the sheet at the conditioning nip breaks only some natural bonds connecting laterally adjacent fiber bundles in the sheet.

12. The cane processing assembly of claim 11 wherein the roller biasing unit is adjustable to vary the spring bias applied to the first and second conditioning rollers.

13. The cane processing assembly of claim 11 wherein the first guide roller is made of metal and the grooved treads of the second guide roller are made of rubber.

14. The cane processing assembly of claim 11 wherein the first and second guide rollers are spring biased toward each other to apply pressure to the sheet.

15. A cane processing system for use with a substantially flattened sheet of bamboo culm or vegetable cane, wherein the sheet has a longitudinal axis and a plurality of longitudinally oriented fiber bundles extending along the longitudinal axis and connected laterally to each other by natural bonds, the system comprising:

a cane conditioning assembly comprising a plurality of conditioning roller sets, each conditioning roller set comprising:

a first conditioning roller having a circumferentially aligned first set of alternating rectangular grooves having sidewalls positioned apart at a first width and protrusions having a second width;

a second conditioning roller having a circumferentially aligned second set of alternating rectangular grooves having sidewalls positioned apart at the first width and protrusions having the second width;

a frame coupling the first and second conditioning rollers in a position adjacent to each other with the first set of alternating rectangular grooves and protrusions interleaved with the second set of alternating rectangular grooves and protrusions such that each protrusion is partially received in a mating rectangular groove to form a conditioning nip, the first and second conditioning rollers configured to apply a pressure to the sheet at the conditioning nip; and a roller biasing unit coupled to the first and second conditioning rollers and configured to adjust the position of the first and second conditioning rollers relative to each other so as to vary the pressure applied to the sheet by the first and second conditioning rollers; and an input conveying unit positioned to receive and advance the sheet into the cane conditioning assembly in a direction such that the plurality of longitudinally oriented fiber bundles are aligned with the first and second set of alternating rectangular grooves and protrusions, wherein the pressure applied to the sheet at the conditioning nip breaks only some natural bonds connecting laterally adjacent fiber bundles in the sheet;

an output guide roller having a first output roller with a smooth cylindrical surface and a second output roller positioned adjacent to the first output roller, wherein the second output roller has a cylindrical surface having grooved treads configured to pull the sheet out of the cane conditioning assembly; and an output conveying unit positioned to receive the sheet from the output guide roller.

16. The cane processing system of claim 15 wherein each of the plurality of conditioning roller sets is configured to apply a different amount of pressure to the sheet.

17. The cane processing system of claim 16 wherein each roller biasing unit of each of the plurality of conditioning roller sets is configured to apply a different amount of spring bias to the corresponding first and second conditioning rollers.

18. The cane processing system of claim 16 wherein each of the plurality of conditioning roller sets has a different rectangular groove size.

19. The cane processing system of claim 15, further comprising a roller driver coupled to each of the plurality of conditioning roller sets, the roller driver configured to rotate the first and second conditioning rollers of each of the plurality of conditioning roller sets in opposing directions so as to advance the sheet through the cane conditioning assembly.

20. The cane processing system of claim 15 wherein the first output roller is made of metal and the grooved treads of the second output roller are made of rubber.

21. The cane processing system of claim 15 wherein the first and second output rollers are spring biased toward each other to apply pressure to the sheet.

* * * * *